US005568730A

United States Patent [19]

Kim et al.

[11] Patent Number: 5,568,730

[45] Date of Patent: Oct. 29, 1996

[54] DEODORIZING DEVICE FOR REFRIGERATOR

[75] Inventors: Ho C. Kim; Sang B. Kim, both of Kyungsangnam-Do, Rep. of Korea

[73] Assignee: Goldstar Co., Ltd., Seoul, Rep. of Korea

[21] Appl. No.: 335,920

[22] Filed: Nov. 8, 1994

[30] Foreign Application Priority Data

Nov. 26, 1993 [KR] Rep. of Korea ..... 25208/1993
Dec. 30, 1993 [KR] Rep. of Korea ..... 30992/1993

[51] Int. Cl.[6] ..... F24F 3/16; A62B 7/08

[52] U.S. Cl. ..... 62/78; 422/123; 62/441

[58] Field of Search ..... 62/78, 441; 422/122, 422/123

[56] References Cited

U.S. PATENT DOCUMENTS

| | | | |
|---|---|---|---|
| 4,948,567 | 8/1990 | Atarashiya | 62/78 X |
| 4,955,208 | 9/1990 | Kawashima et al. | 62/78 X |
| 5,078,971 | 1/1992 | Matuda et al. | 62/78 X |
| 5,230,220 | 7/1993 | Kang et al. | 62/78 |
| 5,347,820 | 9/1994 | In Gweon | 62/78 |

FOREIGN PATENT DOCUMENTS

| | | | |
|---|---|---|---|
| 0476724A2 | 1/1989 | European Pat. Off. | F25D 17/04 |
| 1-300847 | 12/1989 | Japan | A23B 7/152 |
| 3-087585 | 4/1991 | Japan | F25D 23/00 |
| 4-179437 | 6/1992 | Japan | A23B 7/144 |
| 4-334618 | 11/1992 | Japan | 62/78 |
| 5-157444 | 6/1993 | Japan | 62/78 |

*Primary Examiner*—Henry A. Bennett
*Assistant Examiner*—Susanne C. Tinker
*Attorney, Agent, or Firm*—Fliesler, Dubb, Meyer & Lovejoy

[57] ABSTRACT

A deodorizing device for a refrigerator is disclosed. The deodorizing device includes a deodorizing unit which is detachably mounted to a cooling air return port of a cooling chamber and sucks the cooling air laden with odor and bacteria thereinto by the blowing force of a cooling air fan. The deodorizing unit includes a cooling air grille provided with a plurality of cooling air through holes, a deodorant container provided on each side of the top surface of the grille a guide cover detachably coupled to the grille for guiding the cooling air to the cooling: air return passage, and a fixing plate for fixing the guide cover to an inner case of the freezing chamber so as to mount the deodorizing unit to the second cooling air return port. The fixing plate is placed on the top of the guide cover.

3 Claims, 4 Drawing Sheets

DEODORIZING DEVICE FOR REFRIGERATOR

BACKGROUND OF THE INVENTION

1. Field of the invention

The present invention relates in general to a deodorizing device for a refrigerator and, more particularly, to a deodorizing device provided in a cooling chamber of the refrigerator and deodorizing and sterilizing the cooling air of the cooling chamber, thereby deodorizing and sterilizing the refrigerator.

2. Description of the Prior Art

With reference to FIG. 1, there is shown in a side sectional view a refrigerator having a typical deodorizing device. As shown in this drawing, the refrigerator includes a freezing chamber 200 and a cooling chamber 300, which chambers 200 and 300 are defined in the upper section and in the lower section of the interior of a refrigerator casing 100 respectively. The front of the freezing chamber 200 is provided with a freezing chamber door 220, while the frost of the cooling chamber 300 is provided with a cooling chamber door 320. Placed in the upper section in the space defined in the rear wall of the freezing chamber 200 is a cooling air fan 210 for drawing the cooling air to the freezing chamber 200 and to the cooling chamber 300. In order to introduce the cooling air of the fan 210 into the freezing chamber 200, a first cooling air inlet 240 is provided in the rear wall of the freezing chamber 200 in front of the cooling air fan 210. Placed under the cooling air fan 210 is an evaporator 230 for absorbing heat of cooling air, which cooling air was generated through a cooling air generating cycle of the refrigerator and circulated in the freezing chamber 200 and in the cooling chamber 300.

The freezing chamber 200 insulated from the cooling chamber 300 by both an upper insulating wall 260 and a lower insulating wall 270. A cooling air return passage 280 is defined between the upper insulating wall 260 and the lower insulating wall 270, so that the freezing chamber 200, the evaporator 230 and the cooling chamber 300 communicate with each other through the return passage 280. The cooling air return passage 280 communicates with the freezing chamber 200 through a first cooling air return port 290, which port 290 sucks the cooling air, after circulating in the freezing chamber 200, into the passage 280. In the same manner, the cooling air return passage 280 communicates with the cooling chamber 300 through a second cooling air return port 340, which port 340 sucks the cooling air, after circulating in the cooling chamber 300, into the passage 280. A cooling air passage 250 for introducing the cooling air into the cooling chamber 300 is provided in back of the evaporator 230. The cooling air passage 250 opens to the cooling chamber 300 at a second cooling air inlet 330, which inlet 330 introduces the cooling air of the passage 250 into the cooling chamber 300. Provided in upper section of the interior rear wall of the cooling chamber 300 is a deodorizing device 310. The device 310 includes a deodorizing fan 311 for forcibly circulating the cooling air of the cooling chamber 300 and for deodorizing and sterilizing the cooling air of the cooling chamber 300. The deodorizing device 310 also includes a deodorant 312. In operation of the above refrigerator having the typical deodorizing device 310, a low temperature refrigerant which has been cooled by a refrigerating cycle of the refrigerator is introduced into the evaporator 230 wherein the refrigerant exchanges heat with the surrounding air about the evaporator 230, thus to absorb the heat of the surrounding air and to cool the air. The cooled surrounding air or the cooling air in turn is forcibly blown by the cooling air fan 210, so that a part of the cooling air is introduced into the freezing chamber 200 through the first cooling air inlet 240 provided in front of the fan 210. The cooling air introduced into the freezing chamber 200 circulates in the chamber 200 while absorbing the heat of the freezing chamber 200 and, thereafter, returns to about the evaporator 230 through the first cooling air return port 290 and the cooling air return passage 280. At the evaporator 230, the return cooling air exchanges heat with the low temperature refrigerant of the evaporator 230, thus to be cooled. The cooling air after heat exchanging at the evaporator 230 is again introduced into the freezing chamber 200 and circulates in the chamber 200 in the same manner as described above. The suction force for sucking the cooling air, after circulating in the freezing chamber 200, at the first cooling air return port 290 is generated by the cooling air fan 210.

Meanwhile, a pan of the cooling air is introduced into the cooling chamber 300 through the cooling air passage 250 and the second cooling air inlet 330. The cooling air introduced into the cooling chamber 300 circulates in the chamber 300 while absorbing the heat of the cooling chamber 300 and, thereafter, returns to about the evaporator 230 through the second cooling air return port 340 and the cooling air return passage 280. At the evaporator 230, the return cooling air exchanges heat with the low temperature refrigerant of the evaporator 230, thus to be cooled. The cooling air after heat exchanging at the evaporator 230 is again introduced into the cooling chamber and circulates in the chamber 200 in the same manner as described above.

In the above operation of the refrigerator, the deodorizing device 310 provided in the interior of the cooling chamber 300 deodorizes and sterilizes the cooling air of the refrigerator. That is, the cooling air of the cooling chamber 300 forcibly circulates in the cooling chamber 300 by the blowing force of the deodorizing fan 311 of the device 310. During the forcible circulation of the cooling air in the cooling chamber 300, the cooling air laden with odor and bacteria is deodorized and sterilized by the deodorant 312 of the device 310.

However, it has been noted that the above deodorizing device 310 has the following problems.

That is, the deodorizing device is provided with its own fan for forcibly circulating the cooling air of the cooling chamber in order to deodorize and sterilize the cooling air. However, the fan of the deodorizing device generates operational noise and causes increase of cost of the refrigerator. In addition, it is preferred to periodically change the deodorant with new one after lapse of predetermined time in order to achieve desired deodorizing and sterilizing effect. However, the above deodorizing device is fixedly mounted to the rear wall of the cooling chamber, which rear wall is without ready reach of a user, so that the deodorant can not periodically changed with new one. In this regard, the above deodorizing device will be deteriorated in its deodorizing and sterilizing effect with the lapse of time and will fail in keeping desired sanitation of the refrigerator.

SUMMARY OF THE INVENTION

It is, therefore, an object of the present invention to provide a deodorizing device for a refrigerator in which the above problems can be overcome and which is provided in a cooling air return port of a cooling chamber, thus to achieve desired deodorizing and sterilizing effect without addition of typical deodorizing fan.

It is another object of the present invention to provide a deodorizing device for a refrigerator which is detachably mounted to the cooling air return port of the cooling chamber, thus to readily change a deodorant cake with new one after lapse of predetermined time and to keep the deodorizing effect for a long time.

In order to accomplish the above object, a deodorizing device for a refrigerator in accordance with a preferred embodiment of the present invention comprises: a cooling air return passage defined between an upper insulating wall and a lower insulating wall, the insulating walls dividing the interior of the refrigerator into a freezing chamber and a cooling chamber, and the cooling air return passage making an evaporator, the freezing chamber and the cooling chamber communicating with each other; a first cooling air return port formed between the cooling air return passage and the freezing chamber so as to connect the return passage to the freezing chamber, the first return port introducing cooling air of the freezing chamber to the return passage; a second cooling air return port formed between the cooling air return passage and the cooling chamber so as to connect the return passage to the cooling chamber, the second return port introducing cooling air of the cooling chamber to the return passage; and a deodorizing unit for deodorizing and sterilizing the cooling air of the cooling chamber, the deodorizing unit being provided in the second cooling air return port.

BRIEF DESCRIPTION OF THE DRAWINGS

Other objects and aspects of the invention will become apparent from the following description of embodiments with reference to the accompanying drawings in which.

DESCRIPTION OF THE PREFERRED EMBODIMENTS

Figure 1:
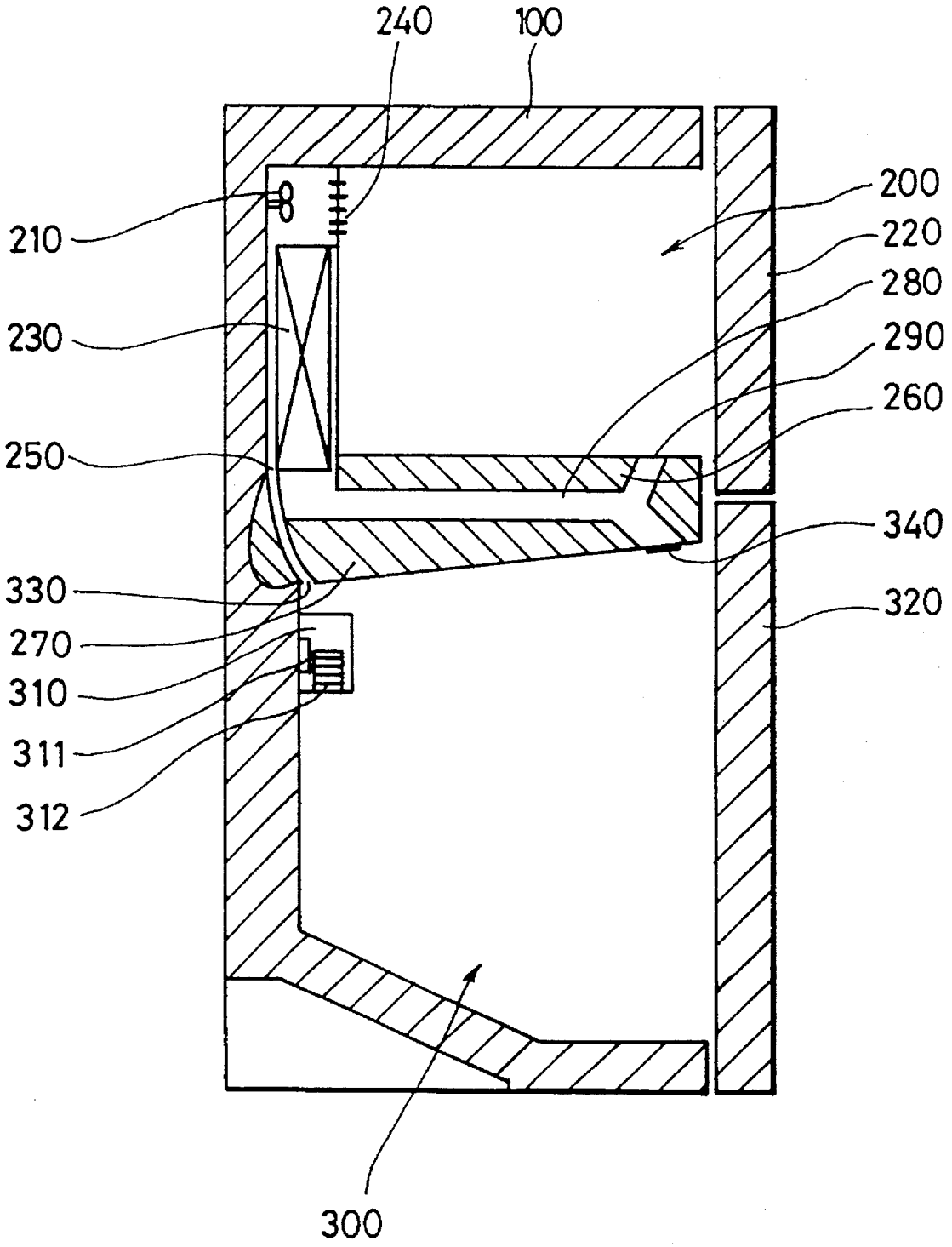
FIG. 1 CONVENTIONAL ART
FIG. 1 is a side sectional view of a refrigerator having a typical deodorizing device.

In the present invention, the general configuration and general construction except for deodorizing device of the refrigerator remain the same as those of the typical refrigerator of FIG. 1. Therefore, further explanation for the general configuration and general construction of the refrigerator will be omitted from the following description.

Figure 2:
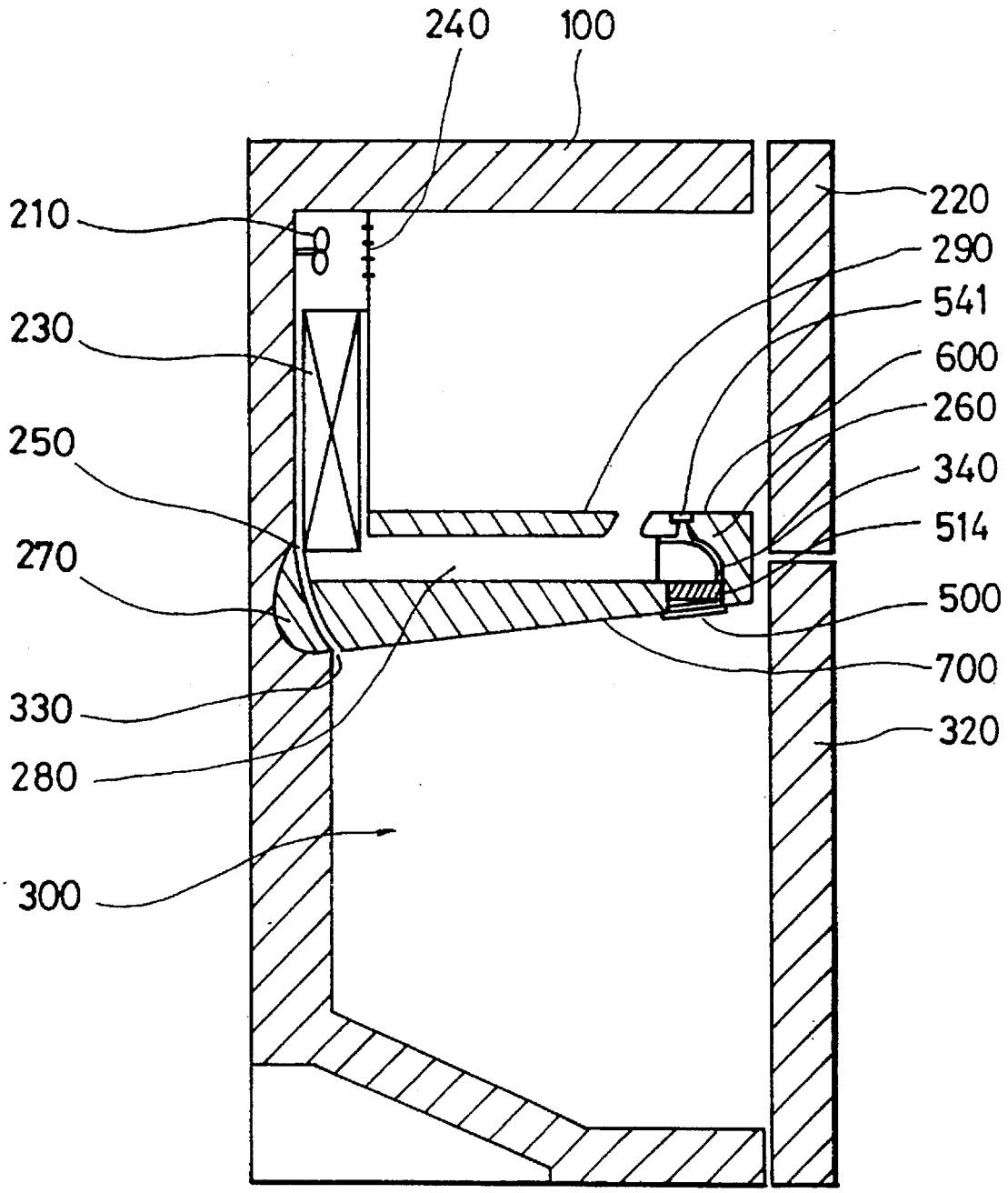
FIG. 2 is a side sectional view of a refrigerator having a deodorizing device in accordance with a preferred embodiment of the present invention.

With reference to FIG. 2, there is shown in a side sectional view a refrigerator having a deodorizing device in accordance with a preferred embodiment of the present invention. In the refrigerator of this invention, a deodorizing unit 500 of the deodorizing device is detachably mounted to a cooling air return port 340 of a cooling chamber 300.

Figure 3:
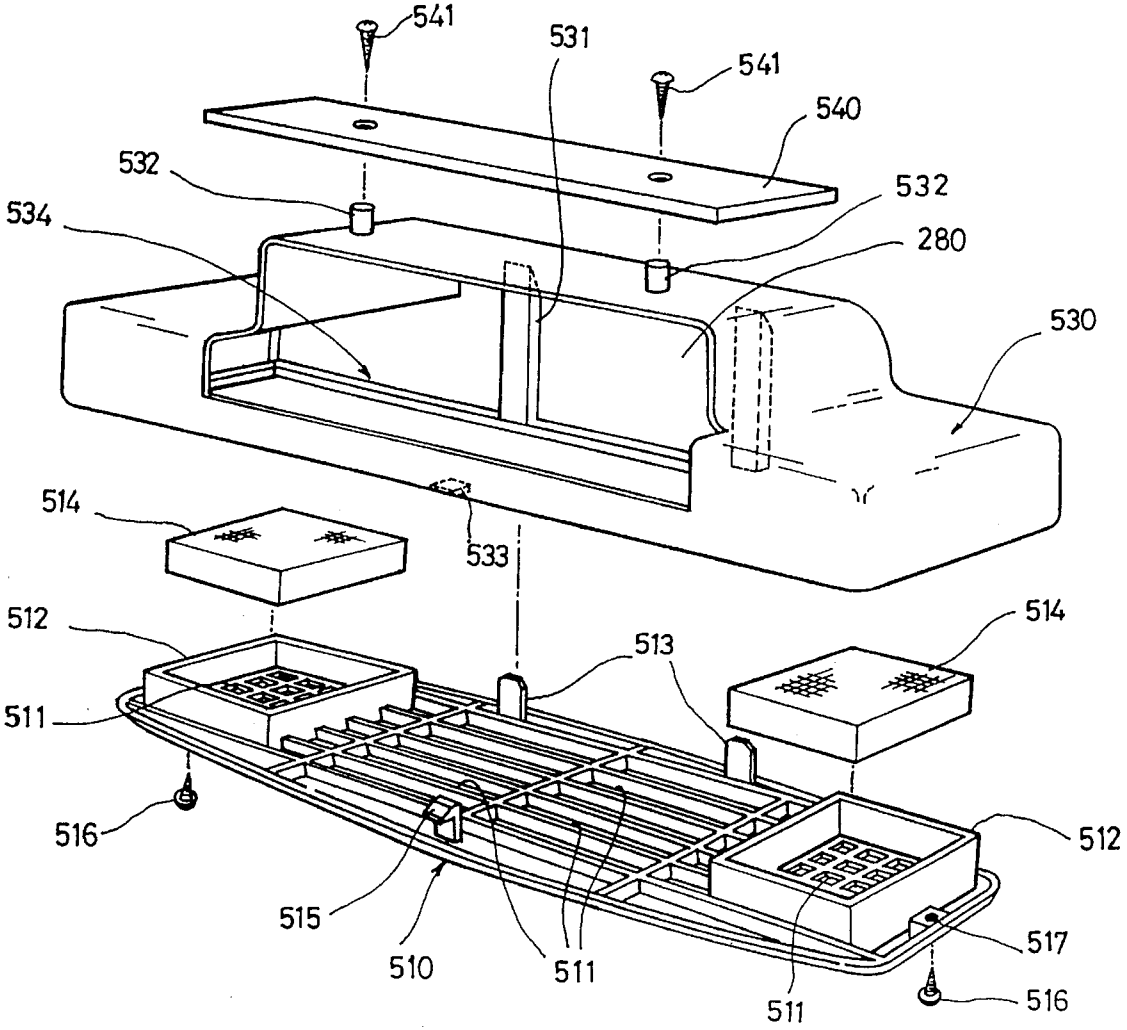
FIG. 3 is an exploded perspective view of a deodorizing unit of the deodorizing device of the invention.
Figure 4:
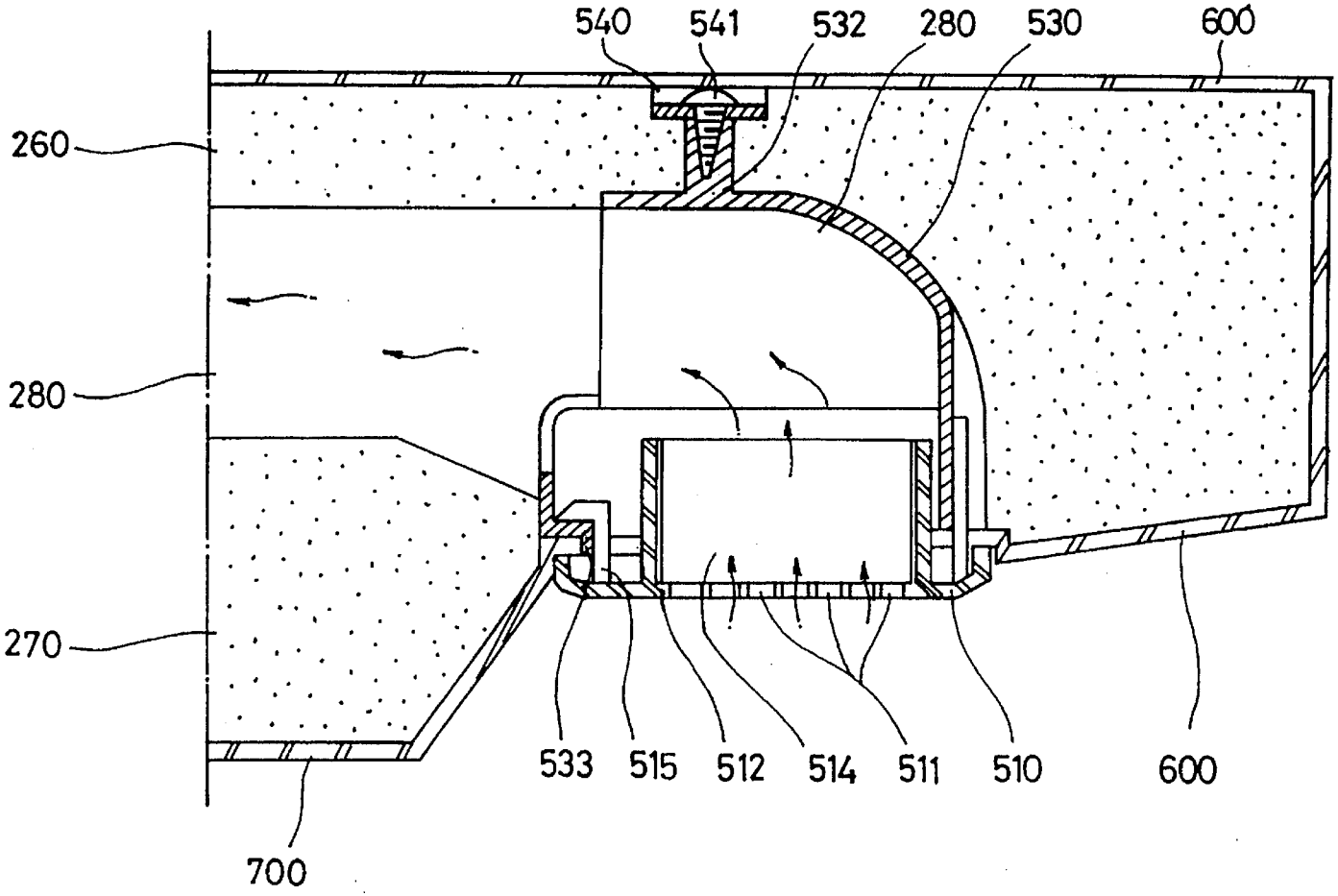
FIG. 4 is an enlarged sectional view of a second cooling air return port provided with the deodorizing unit of the device of the invention.

FIG. 3 is an exploded perspective view of the deodorizing unit 500 and FIG. 4 is an enlarged sectional view of the cooling air return port 340 provided with the deodorizing unit 500. As shown in these drawings, the deodorizing unit 500 includes a plate type cooling air grille 510. The grille 510 which constitutes a detachable bottom of the deodorizing unit 500 is wholly provided with a plurality of cooling air through holes 511, the holes 511 allow the cooling air of the cooling chamber 300 to be free sucked into the deodorizing unit 500 therethrough.

The opposed sides of the top surface of the grille 510 are provided with their respective deodorant containers 512 of the box type. The deodorant containers 512 receive their respective hexahedral deodorant cakes 514 therein. The grille 510 also includes a snap hook 515 for allowing the grille 510 to be brought into detachable engagement with a guide cover 530, which snap hook 515 is provided in the front section of the top surface of the grille 510. A plurality of support ribs 513 extend upwardly from the rear section of the grille 510. The support ribs 513, which are spaced out at a predetermined interval, will be inserted into their associated hollow ribs 531 of the guide cover 530 when assembling the grille 510 and the guide cover 530 into the deodorizing unit. The grille 510 further includes a plurality of screw holes 517 on its opposed edges. When assembling the grille 510 and the guide cover 530 into the deodorizing unit 500, a plurality of set screws 516 are upwardly inserted into their respective screw holes 517 of the grille 510 and screw the grille 510 to the guide cover 530.

The guide cover 530 which is brought into detachable engagement with the grille 510 using the set screw 516 is a casing which has a partially bulged top and opens to the front, to the back and to the bottom. The bottom of the guide cover 530 is provided with rectangular support frame 534. The support frame 534 has the plurality of hollow ribs 531 for receiving the support ribs 513 of the grille 510 therein. The partially bulged top of the guide cover 530 is provided with a plurality of bosses 532 extending upwardly from the bulged top surface of the cover 530. When mounting the deodorizing unit 500, which unit 500 includes the grille 510, the deodorant cakes 514 and the guide cover 530, to the second cooling air return port 340 of the cooling chamber 300, the deodorizing unit 500 is placed in the port 340 so that the bosses 532 are upwardly received in their associated holes of an inner case 600 of the freezing chamber 200. Thereafter, the bosses 532 of the guide cover 530 are screwed to the inner case 600 with interposition of a mounting plate 540. At this time, a plurality of set screws 541 are downwardly screwed into the bosses 532 of the guide cover 530. The front interior surface of the guide cover 530 is provided with a snap projection 533, which projection 533 is brought into snap engagement with the snap hook 515 of the grille 510 when assembling the grille 510 and the guide cover 530 into the deodorizing unit 500.

In FIG. 4, the reference numeral 700 denotes an inner case of the cooling chamber 300.

In operation of the above refrigerator having the deodorizing device, the low temperature refrigerant which has been cooled by a refrigerating cycle of the refrigerator is introduced into the evaporator 230 wherein the low temperature refrigerant exchanges heat with the surrounding air about the evaporator 230, thus to absorb the heat of the surrounding air and to cool the air. The cooled surrounding air or the cooling air in turn is forcibly blown by the cooling air fan 210, so that a part of the cooling air is introduced into the freezing chamber 200 through the first cooling air inlet 240 provided in front of the fan 210. The cooling air introduced into the freezing chamber 200 circulates in the chamber 200 while absorbing the heat of the freezing chamber 200 and, thereafter, returns to about the evaporator 230 through the first cooling air return port 290 and the cooling air return passage 280. At the evaporator 230, the return cooling air exchanges heat with the low temperature refrigerant of the evaporator 230, thus to be cooled. The cooling air after heat exchanging at the evaporator 230 is again introduced into the freezing chamber 200 and circulates in the chamber 200 in the same manner as described above. The suction force for sucking the cooling air, after circulating in the freezing chamber 200, at the first cooling air return port 290 is generated by the cooling air fan 210.

Meanwhile, a part of the cooling air is also introduced into the cooling chamber 300 through the cooling air passage 250 and the second cooling air inlet 330. The cooling air introduced into the cooling chamber 300 circulates in the chamber 300 while absorbing the heat of the cooling chamber 300 and, thereafter, returns to about the evaporator 230 through the second cooling air return port 340 and the cooling air return passage 280. At the evaporator 230, the return cooling air exchanges heat with the low temperature refrigerant of the evaporator 230, thus to be cooled. The cooling air after heat exchanging at the evaporator 230 is again introduced into the cooling chamber 300 and circulates in the chamber 200 in the same manner as described above.

When sucking the cooling air of the cooling chamber 300 through the second return port 340, the cooling air laden with odor and bacteria passes through the deodorizing unit 500 placed in the second return chamber 340. That is, the cooling air laden with odor and bacteria is sucked into the deodorizing unit 500 through the cooling air through holes 511 of the grille 510 due to the blowing force of the cooling air fan 210. At this time, a part of cooling air passing through the deodorant containers 512 of the grille 510 comes into contact with the deodorant cakes 514 received in the containers 512, so that the odor and bacteria of the cooling air are filtered off and the cooling air is partially refreshed. The cooling air, after being processed by the deodorizing unit 500, is introduced to about the evaporator 230 wherein the cooling air exchanges heat with the low temperature refrigerant so as to be cooled. The cooling air, after being cooled by the evaporator 230, circulates in the refrigerator in the same manner as described above, so that the odor and bacteria of the cooling air are again removed and the deodorizing and sterilizing effect of the device is more improved. When changing each deodorant cake 514 with new one after lapse of predetermined time, the grille 510 is pressed up about the hook 515, so that the hook 515 is disengaged from the projection 533. In this state, the grille 510 is readily separated frown the guide cover 530 tightly screwed to the inner case 600 of the freezing chamber 200. After separation of the grille 510 from the guide cover 530, new deodorant cakes may be readily substituted for the old deodorant cakes 514.

As described above, a deodorizing device for a refrigerator in accordance with the invention is mounted to a cooling air return port of a cooling chamber and sucks the cooling air laden with odor and bacteria using suction force of a cooling air fan placed above an evaporator and refreshes the cooling air, thus to achieve desired deodorizing and sterilizing effect without addition of typical deodorizing fan. Therefore, the deodorizing device of the invention simplifies the construction of the refrigerator and reduces the cost of the refrigerator.

Furthermore, the deodorizing unit of the deodorizing device of the invention is detachably mounted to the cooling air return port within ready reach of a user, thus to change the deodorant with new one after lapse of predetermined time and to keep the deodorizing and sterilizing effect for a long time.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A deodorizing device for a refrigerator comprising:

a cooling air return passage defined between an upper insulating wall and a lower insulating wall of the refrigerator, said insulating walls dividing the interior of the refrigerator into a freezing chamber and a cooling chamber, and said cooing air return passage communicating an evaporator, and the freezing chamber and the cooling chamber with each other;

a first cooling air return port formed between the cooling air return passage and the freezing chamber so as to connect the return passage to the freezing chamber, said first cooling air return port introducing cooling air of the freezing chamber to the return passage;

a second cooling air return port formed between the cooling air return passage and the cooling chamber so as to connect the cooling air return passage to the cooling chamber, said second cooling air return port introducing cooling air of the cooling chamber to the return passage;

a deodorizing unit for deodorizing and sterilizing the cooling air, said deodorizing unit being detachably mounted to the second cooling air return port;

a cooling air grille detachably mounted in said second cooling air return port and provided with a plurality of cooling air through-holes;

a deodorant container provided on each side of an inner surface of said cooling air grille, each said deodorant, container removably receiving deodorant therein;

a guide cover detachably coupled to said cooling air grille for guiding the cooling air to the cooling air return passage; and a fixing plate for fixing said guide cover to an inner case of the freezing chamber so as to mount the deodorizing unit to the second cooling air return port, said fixing plate being provided on the top of said guide cover.

2. The deodorizing device according to claim 1, wherein a plurality of support ribs are provided on the inner surface of said cooling air grille, said support ribs being inserted into hollow ribs of a support frame of the guide cover.

3. The deodorizing device according to claim 1, wherein a snap hook is provided on a from section of the inner surface of said cooling air grille, said snap hook being engageable with a snap projection provided on a front interior surface of the guide cover.

* * * * *